US011718962B2

(12) United States Patent
Collins et al.

(10) Patent No.: US 11,718,962 B2
(45) Date of Patent: Aug. 8, 2023

(54) NONWOVEN WEB COMPOSITION, METHOD TO PREPARE THE COMPOSITION AND ARTICLES THEREOF

(71) Applicant: Jacob Holm & Sons AG, Basel (CH)

(72) Inventors: Geoff Collins, Basel (CH); Santosh Chavan, Basel (CH)

(73) Assignee: Jacob Holm & Sons AG, Basel (CH)

( * ) Notice: Subject to any disclaimer, the term of this patent is extended or adjusted under 35 U.S.C. 154(b) by 304 days.

(21) Appl. No.: 16/750,433

(22) Filed: Jan. 23, 2020

(65) Prior Publication Data

US 2021/0230808 A1 Jul. 29, 2021

(51) Int. Cl.

| | |
|---|---|
| ***D21H 27/42*** | (2006.01) |
| ***D21H 11/12*** | (2006.01) |
| ***D21H 13/08*** | (2006.01) |
| ***D21H 13/14*** | (2006.01) |
| ***D21H 13/24*** | (2006.01) |

(Continued)

(52) U.S. Cl.

CPC ..... *D21H 27/42* (2013.01); *D21H 11/12* (2013.01); *D21H 13/08* (2013.01); *D21H 13/14* (2013.01); *D21H 13/24* (2013.01); *D21H 13/26* (2013.01); *D21H 13/34* (2013.01); *D21H 15/10* (2013.01)

(58) Field of Classification Search

CPC ..... D21H 27/42; D21H 11/12; D21H 13/08; D21H 13/14; D21H 13/24; D21H 13/26; D21H 13/34; D21H 15/10; D04H 1/732; D04H 1/492

See application file for complete search history.

(56) References Cited

U.S. PATENT DOCUMENTS 4,767,586 A * 8/1988 Radwanski ..... D04H 1/732 425/81.1
5,147,345 A * 9/1992 Young ..... A61F 13/49466 604/374

(Continued)

FOREIGN PATENT DOCUMENTS

WO WO-2007140578 A1 * 12/2007 ..... D01C 1/02
WO WO 2014/039361 A1 3/2014

(Continued)

OTHER PUBLICATIONS

International Search Report and Written Opinion dated May 18, 2021 in PCT/IB2021/000002, 19 pages.

*Primary Examiner* — Jose A Fortuna
(74) *Attorney, Agent, or Firm* — Oblon, McClelland, Maier & Neustadt, L.L.P.

(57) ABSTRACT

A nonwoven web, containing at least one first homogeneous layer consisting of a blend of at least one of defibrated natural plant based fibers, individualized natural plant based fibers and staple fibers is provided. The nonwoven web contains no binder, adhesive or thermal bonding fibers and a basis weight of the at least one homogeneous layer is from 20 g/m$^2$ to 100 g/m$^2$. When a weighted average fiber length of the blend is greater than about 4.0 mm, the nonwoven web is a non-dispersible product which does not meet the requirement for dispersibility in accordance with INDA/EDANA GD4, and when a weighted average fiber length of the blend is less than about 4.0 mm, the nonwoven web is a dispersible product as defined in accordance with INDA/EDANA GD4. Methods to prepare the nonwoven web are provided.

25 Claims, 2 Drawing Sheets

(51) Int. Cl.

| | |
|---|---|
| ***D21H 13/26*** | (2006.01) |
| ***D21H 13/34*** | (2006.01) |
| ***D21H 15/10*** | (2006.01) |

(56) References Cited

U.S. PATENT DOCUMENTS

| | | | | |
|---|---|---|---|---|
| 5,238,534 | A * | 8/1993 | Manning | D21H 17/53 162/146 |
| 5,318,554 | A * | 6/1994 | Young | A61L 15/425 604/374 |
| 7,250,382 | B2 * | 7/2007 | Takai | D21H 11/12 162/147 |
| 8,250,719 | B2 | 8/2012 | Ouellette | |
| 9,394,637 | B2 * | 7/2016 | Knowlson | D04H 1/46 |
| 9,926,654 | B2 * | 3/2018 | Baer | B32B 27/32 |
| 9,926,655 | B2 * | 3/2018 | Baer | B32B 7/12 |
| 9,949,609 | B2 * | 4/2018 | Baer | A47L 13/17 |
| 10,415,166 | B2 * | 9/2019 | Knowlson | D04H 1/43835 |
| 10,519,579 | B2 * | 12/2019 | Baer | B32B 27/12 |
| 10,889,922 | B2 * | 1/2021 | Castillo | B32B 5/08 |
| 11,118,290 | B2 * | 9/2021 | Wright | D04H 1/425 |
| 2003/0100240 | A1 * | 5/2003 | Takai | D21H 25/005 442/340 |
| 2010/0227138 | A1 | 9/2010 | Ouellette | |
| 2014/0066872 | A1 * | 3/2014 | Baer | B32B 38/0012 28/169 |
| 2014/0170402 | A1 * | 6/2014 | Knowlson | A61K 8/0208 264/103 |
| 2014/0259484 | A1 * | 9/2014 | Baer | A61Q 19/005 15/104.93 |
| 2014/0273704 | A1 * | 9/2014 | Baer | B32B 5/022 156/181 |
| 2016/0201239 | A1 * | 7/2016 | Baer | D04H 1/425 156/60 |
| 2016/0228337 | A1 * | 8/2016 | Knowlson | D04H 1/492 |
| 2016/0355857 | A1 * | 12/2016 | Hiltunen | C08B 15/02 |
| 2017/0002486 | A1 * | 1/2017 | Castillo | B32B 5/26 |
| 2017/0233909 | A1 * | 8/2017 | Wright | B32B 5/26 428/172 |
| 2018/0251925 | A1 * | 9/2018 | Knowlson | A47K 7/00 |
| 2018/0326699 | A1 * | 11/2018 | Knowlson | D04H 1/43835 |
| 2021/0002800 | A1 | 1/2021 | Finnis | |
| 2021/0123190 | A1 * | 4/2021 | McKee | D21H 27/30 |
| 2021/0230808 | A1 * | 7/2021 | Collins | D21H 27/42 |

FOREIGN PATENT DOCUMENTS

| | | | | |
|---|---|---|---|---|
| WO | WO 2014/092806 | A1 | 6/2014 | |
| WO | WO 2018/212904 | A1 | 11/2018 | |
| WO | WO 2019/180681 | A1 | 9/2019 | |
| WO | WO-2021148874 | A1 * | 7/2021 | D21H 11/12 |

* cited by examiner

NONWOVEN WEB COMPOSITION, METHOD TO PREPARE THE COMPOSITION AND ARTICLES THEREOF

FIELD OF THE INVENTION

This invention is directed to nonwoven web compositions which are free of binders, adhesives and thermal bonding fibers and are economical and useful for a wide range of utilities. Depending on its structure and composition the web may be dispersible according to INDA/EDANA GD4 or may not be dispersible. The invention is also directed to a continuous process to prepare the nonwoven web which employs a minimal number of operations and provides an economical nonwoven web article which is useful for a wide range of utilities depending on the structure and composition of the article.

BACKGROUND OF THE INVENTION

Nonwoven substrates are employed for the production of a wide variety of consumer products, often times which are generally used once and discarded. Such products include disposable cleansing wipes, disposable diapers, disposable adult incontinence products, disposable pads typically employed in hospitals for absorption of body fluids and cosmetic applicators or cosmetic pads for removal of make-up and other materials from a keratinous substrate.

Such commercial products constitute an industry having ever increasing growth potential and expansion of utility especially having improved performance properties while being of lower cost and/or low environmental impact. Many such products potentially enter the environment through landfill or sewage systems, and thus, on one hand there is a need for nonwoven web compositions that are simple to produce, contain a minimal or no amount of chemical components that have poor biodegradability such as binders, adhesives or thermoplastic polymers and yet have good wet tensile strength as required for performance. In such products water dispersibility is considered an advantage. In a different range of nonwoven compositions, water dispersibility may not be a useful characteristic and other properties such as high tensile strength combined with low cost and low environmental impact may be the important parameters.

Conventionally, nonwoven disposable wipe products can be produced via one of two basic technologies known in the industry as "airlace" and "hydraspun" processes. Different producers may conduct these technologies with variation based on intended end use and available production equipment but the basic principles of operation are retained.

Airlace methods combine the operations of depositing an airlaid web of staple length fibers and wood pulp fibers onto a nonwoven carrier layer or precursor base nonwoven web and hydroentangling the airlaid layer with the nonwoven carrier. This technology is described in U.S. Pat. No. 8,250,719 to Ouellette and the references described therein. In addition to employing a carrier web, Ouellette describes bonding the airlaid fibers with hot air or a spray adhesive.

According to the "hydraspun" method as described in U.S. Pat. No. 4,755,421 to Manning et al. a wetlaid web of pulp and manmade fibers is hydroentangled and dried. However, U.S. Pat. No. 5,292,581 to Viazmensky et al. indicates that such products suffer from poor wet strength and describe that the addition of binders substantially improves the strength. More recently, U.S. Pat. No. 7,732,357 to Annis et al. describes the use of binder fibers to the nonwoven sheet that upon heating become activated by at least partial melting and form fiber to fiber bonds. The binder fibers contain polyethylene, polypropylene, polyethylene terephthalate and mixtures thereof.

Applicants have described a continuous method for the production of nonwoven webs of specific compositions in U.S. Pat. No. 9,394,637, issued Jul. 19, 2016, and U.S. Pat. No. 10,415,116, issued Sep. 17, 2019.

However, there remains a need for a nonwoven webs that do not include adhesives, binders or binder fibers which are economical to produce and have performance properties determined by the materials of the composition. The particular nonwoven web may be dispersible or nondispersible.

There is also a need for a more general method to prepare a nonwoven web of a wider range of materials of construction which is convenient and economical to conduct.

SUMMARY OF THE INVENTION

Thus, an objective of the present invention is to provide a range of nonwoven webs having performance properties determined by the materials of construction, and composition. A second objective is to provide a general method to produce the range of nonwoven webs that includes minimal processing operations, does not use adhesives, binders or binding fibers and provides a nonwoven web having properties advantageous for a selected end use employing a wide range of available materials, including materials which are obtained from sustainable plant sources.

These and other objectives have been achieved according to the present invention, the first embodiment of which includes a nonwoven web, comprising:

at least one first homogeneous layer consisting of a blend of at least one of defibrated or individualized natural plant based fibers and staple fibers; wherein the at least one homogeneous layer comprises no binder, adhesive or thermal bonding fiber, a basis weight of the at least one homogeneous layer is from 20 $g/m^2$ to 100 $g/m^2$, wherein when a weighted average fiber length of the at least one of defibrated natural plant based fibers or individualized natural plant based fibers and staple fibers is greater than about 4.0 mm, the nonwoven web is a non-dispersible product which does not meet the requirement for dispersibility in accordance with INDA/EDANA GD4, and when a weighted average fiber length of the at least one of defibrated natural plant based fibers or individualized natural plant based fibers and staple fibers is less than about 4.0 mm, the nonwoven web is a dispersible product as defined in accordance with INDA/EDANA GD4.

In one aspect of the first embodiment, the nonwoven web comprises a defibrated natural plant based fiber, wherein the defibrated natural plant based fiber is at least one selected from the group consisting of a wood pulp, a cotton pulp, a pulp of a natural plant different from wood and cotton, cotton, cotton linters, cotton combers, bamboo, bast, ramie, hemp, kapok, flax, jute, sisal and abaca.

In another aspect of the first embodiment, the nonwoven web comprises an individualized natural plant based fiber; wherein the individualized natural plant based fiber is at least one selected from the group consisting of a flax fiber, a hemp fiber, a jute fiber, a ramie fiber, a nettle fiber, a Spanish broom fiber and a kenaf plant fiber.

In another aspect of the first embodiment, the nonwoven web comprises a staple fiber which is at least one selected from the group consisting of a regenerated cellulose fiber, cotton, polyethylene terephthalate (PET), polypropylene, polylactic acid, esters of polylactic acid, amides of polylactic acid, milk protein and nylon.

According to the first embodiment combinations of defibrated natural plant based fibers and/or individualized natural plant based fibers and/or staple fibers may be contained in the nonwoven web.

In another aspect of the first embodiment a length-weighted average fiber length of the defibrated or individualized natural plant based fiber is from 0.5 mm to 8.0 mm.

In another aspect of the first embodiment a fiber length of the staple fiber is from 3 mm to 100 mm.

In another aspect of the first embodiment a fineness of the staple fiber is from 0.1 to 10 denier.

In another aspect of the first embodiment a basis weight of the nonwoven web is from 15 g/m$^2$ to 100 g/m$^2$ and in an additional aspect a MD/CD ratio of the nonwoven web is less than 4 as determined according to Nonwoven Standard Procedures (NWSP) 110.4.

In a second embodiment, the present invention provides a method to prepare the nonwoven web according to the first embodiment, comprising:

preparing a homogeneous dry mixture of at least one of defibrated natural plant based fibers, individualized natural plant based fibers and staple fibers;

dry laying the mixture to obtain at least one homogeneous dry laid web;

hydroentangling the dry laid web to consolidate the web on at least one side; and drying the hydroentangled web to obtain the nonwoven web; wherein the dry laying and hydroentangling is conducted in a continuous operation, no binder, adhesive or thermal bonding fibers are utilized, and a thickness of the nonwoven web is from 0.25 mm to 2 mm.

In an aspect of the second embodiment, the dry laying comprises passing the homogeneous dry mixture through a perforated cylinder and air laying onto the foraminous carrier.

In a third embodiment the present invention provides a method to prepare the nonwoven web according to the first embodiment, comprising:

preparing a homogeneous dry mixture consisting of at least one of defibrated natural plant based fibers, individualized natural plant based fibers and staple fibers;

carding and dry laying the mixture to obtain at least one homogeneous dry laid web;

hydroentangling the dry laid web to consolidate the web on at least one side; and drying the hydroentangled web to obtain the nonwoven web; wherein the carding, dry laying and hydroentangling is conducted in a continuous operation, no binder, adhesive or thermal bonding fibers are utilized, and a thickness of the nonwoven web is from 0.25 mm to 2 mm.

In an aspect of the third embodiment the dry laying comprises passing the carded homogeneous dry mixture onto a foraminous carrier.

DETAILED DESCRIPTION OF THE INVENTION

Figure 1:
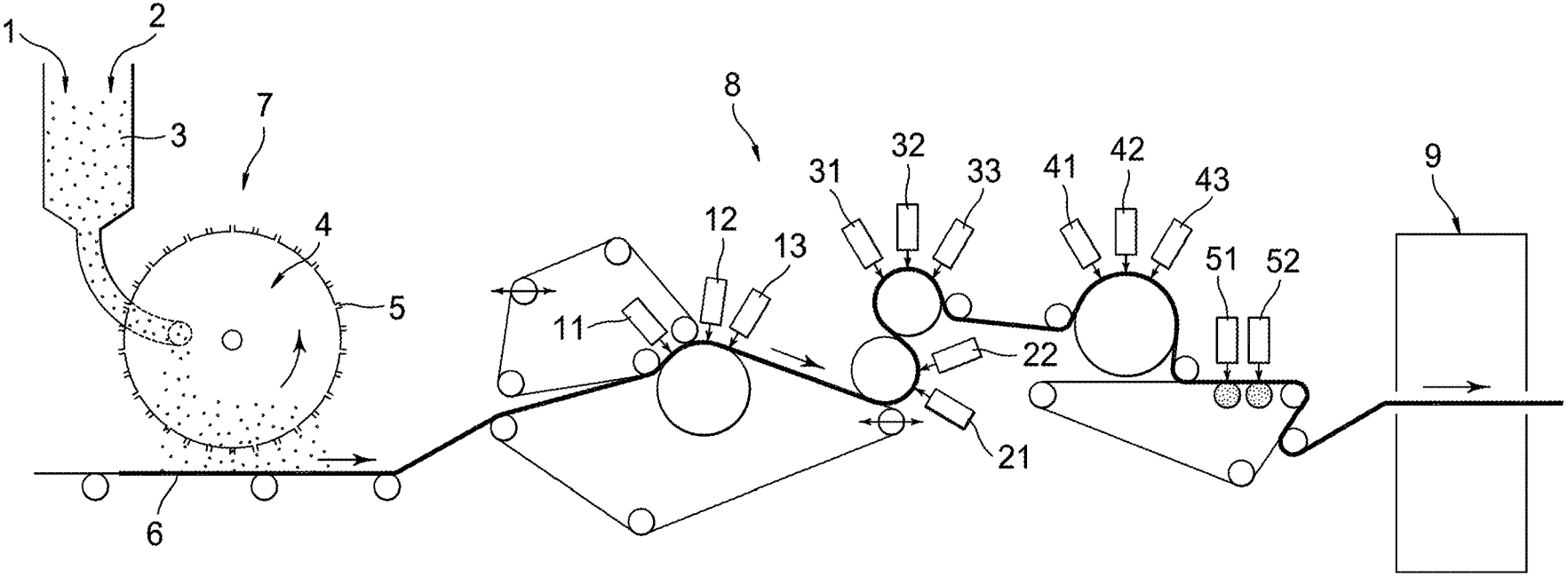
FIG. 1 shows a schematic drawing of a continuous system according to the second embodiment of the invention.

According to the following description, all numerical ranges described include all sub-ranges and all values there between unless otherwise specified. All weight content values are based on total weight. The following description provides a general description of the present invention and specific preferred embodiments. However, one of ordinary skill will recognize that many variations of the invention may be possible without departing from the gist of the invention. This description and the following Claims are intended to include all such variation.

In the following description "plant-based fiber" means a fiber produced by and/or extracted from a plant and does not include fibers of a regenerated type of cellulose. The term "nonwoven" means a web or fabric having a structure of individual fibers which are randomly interlaid and do not have defined pattern such as associated with a knitted or woven fabric.

In a first embodiment, the present invention provides a nonwoven web, comprising: at least one first homogeneous layer consisting of a blend of at least one of defibrated natural plant based fibers, individualized natural plant based fibers and staple fibers; wherein the at least one homogeneous layer comprises no binder, adhesive or thermal bonding fiber, a basis weight of the at least one homogeneous layer is from 20 g/m$^2$ to 100 g/m$^2$, and further wherein when a weighted average fiber length of the at least one of defibrated natural plant based fibers or individualized natural plant based fibers and staple fibers is greater than about 4.0 mm, the nonwoven web is a non-dispersible product which does not meet the requirement for dispersibility in accordance with INDA/EDANA GD4, and when a weighted average fiber length of the at least one of defibrated natural plant based fibers or individualized natural plant based fibers and staple fibers is less than about 4.0 mm, the nonwoven web is a dispersible product as defined in accordance with INDA/EDANA GD4.

The defibrated natural plant based fiber may be at least one selected from the group consisting of a wood pulp, a cotton pulp, a pulp of a natural plant different from wood and cotton, cotton, cotton linters, cotton combers, bamboo, bast, ramie, hemp, kapok, flax, jute, sisal and abaca. This list is not intended to be limiting and fibers of any natural plant which may be defibrated may be employed in the present invention.

According to the present invention the term defibrated means that the fiber is obtained by a mechanical process wherein the pulp in a dry state is broken down to a stage of individual fibers. Typically, defibration may be conducted in a hammermill or hammermill-type device. This structure is distinct and different from pulps typically employed in the paper industry which are fibrillated in a wet stage refining process by application of shearing and compression forces to break down the fiber cell wall and form microscopic hairs on the fiber surface and thus increase the surface area available for bonding.

The defibrated natural plant based fibers may have a fiber length of from 0.5 mm to 8.0 mm, preferably 1.0 mm to 7.0 mm and most preferably from 2.0 to 6.0 mm. Mixtures of any of the natural plant based fibers may be used.

The individualized natural plant based fiber may be at least one bast fiber selected from the group consisting of a flax fiber, a hemp fiber, a jute fiber, a ramie fiber, a nettle fiber, a Spanish broom fiber and a kenaf plant fiber. The term "individualized" means that the bast fiber has been "individualized" to single fibers either mechanically or via a chemical or enzymatic process. The chemical or enzymatic method may remove the pectin which binds the individual fibers while mechanical methods do not remove the pectin.

The individualized natural plant based fiber may have a fiber length of from 3.0 to 100 mm, preferably 4.0 to 50 mm, and most preferably 6.0 mm to 40 mm.

The staple fibers may be at least one fiber selected from the group consisting of a regenerated cellulose fiber, cotton, polyethylene terephthalate (PET), polypropylene, polylactic acid, esters of polylactic acid, amides of polylactic acid, milk protein and nylon and a length of the staple fiber may be from 3.0 mm to 100 mm, preferably 4.0 to 50 mm, and most preferably 6.0 mm to 40 mm.

The fineness of the staple fiber may be from 0.1 to 10 denier, preferably from 1.0 to 8.0 denier and most preferably from 2.0 to 6.0 denier.

The cross sectional geometry of the staple fiber may be of any shape known in the art and for example may be flat, circular, trilobal or X-shaped. Combinations of shapes may be employed as understood by one of skill in the art to obtain targeted performance properties.

According to the first embodiment of this invention, any one or any combination of defibrated natural plant based fibers, individualized natural plant based fibers and staple fibers may be employed in the nonwoven web which is obtained with the methods to be described later. Thus the properties and characteristics offered by each type of fiber may be blended to obtain a nonwoven web of the homogeneously distributed fibers having selected performance properties and utilities.

The nonwoven web may comprise a single type of fiber selected from defibrated natural plant based fibers, individualized natural plant based fibers and staple fibers or may comprise compositions of the three types of fibers in any possible combination and % by weight content. In one aspect the nonwoven web may contain from 10 to 90 weight % of defibrated natural plant based fibers and/or individualized natural plant based fibers; and from 10 to 90 weight % of staple fibers.

The nonwoven web may contain one first homogeneous layer as described above. In addition, a nonwoven web according to the present invention may include multiple stacked layers as described above where the individual nonwoven web layers are of the same composition or have different compositions of at least one of defibrated natural plant based fibers, individualized natural plant based fibers and staple fibers described herein as second homogeneous layer. Webs constructed of multiple different layer compositions may be designed to have properties required for a particular end use and may include multiple different homogeneous compositions, for example, a third homogeneous layer, a fourth homogeneous layer and so on. Thus the nonwoven web may contain from 1 to 10 layers each layer having the same composition or layers may have differing compositions.

The inventors have surprisingly discovered that dispersibility as determined according to INDA/EDANA GD4 may be related to the weighted average length of the fibers included in the nonwoven web. Thus, when fibers are combined which have a weighted average length of greater than about 4.0 mm a nonwoven web which is not dispersible according to INDA/EDANA GD4 may be obtained. It is noted that when the term "about" is associated with a numerical value throughout this description it carries the meaning that variation by as much as 10% of the value is included. Thus, in the present case the weighted average length value associated with dispersibility may vary from 3.6 to 4.4 mm where the variation may be due to the particular fibers included in the nonwoven web.

Elements or variables which may influence the dispersibility relationship to weighted average fiber length may include the composition of the fibers, the length of the various component fibers, the cross sectional geometry of the staple fiber, the method of dry-laying and the energy applied to the web in the hydroentangling operation.

The basis weight of the nonwoven web may be from 15 $g/m^2$ to 100 $g/m^2$ and will vary according to the component fiber composition selected and the method employed to produce the nonwoven web. The basis weight may be controlled by selection of the fiber composition and variables in the method of production and may be determined for a particular end-use according to the selection of all these variables as understood by one of skill in the art.

Due to the composition of the nonwoven web as described above and the methods of manufacture described in the following text, the wet tensile strength of the web in the direction perpendicular (CD) to the machine direction (MD) as measured according to Nonwoven Standard Procedures (NWSP) 110.4 is at least 2.5 N/5 cm. The CD wet tensile strength may be related to the weighted average length of the fiber composition of the web and the value of at least 2.5 N/5 cm may apply to compositions where the weighted average fiber length is less than about 4 mm. When the weighted average fiber length is greater than about 4 mm the CD wet tensile strength may be at least 5 N/5 cm. As described above these values may vary depending on the fibers contained in the particular composition as well as the method of production.

The MD/CD ratio of the web measured according to NWSP 110.4 is less than about 4, preferably less than about 3 and most preferably less than about 2.

In a second embodiment, the present invention provides a method for preparing the homogeneous web described above. The method includes preparing a homogeneous dry mixture of at least one of defibrated natural plant based fibers, individualized natural plant based fibers and staple fibers; dry laying the mixture to obtain a homogeneous dry laid web; hydroentangling the dry laid web to consolidate the web on at least one side; and drying the hydroentangled web to obtain the nonwoven web; wherein the dry laying and hydroentangling is conducted in a continuous operation, no binder, adhesive or thermal bonding fibers are utilized, and a thickness of a single layer of the nonwoven web is from 0.25 mm to 2 mm.

Generally, any dry-laying operation which produces a dry nonwoven web having the component fibers homogeneously distributed within the web structure may be included within the present invention. The homogeneous distribution of the fibers may be assessed by observation of the web through a microscope. The fibers appear in a uniform concentration through the field of the lens.

One method of forming an air laid web is generally described in U.S. Pat. No. 4,640,810 to Laursen et al. The selected fiber mixture is dry blended to a homogeneous mixture and while supported in an air stream transported to a distributor unit. The distributor unit contains a rotating cylinder or drum that is perforated with holes, slots or other appropriately shaped apertures designed to allow passage of the fibers onto a foraminous carrier. The construction of the drum and configuration and size of the apertures may be varied according to the characteristics of the fiber mixture to be employed and to obtain unique web construction. Under the influence of a combination of any of air flow, mechanical agitation within the drum and suction from beneath the carrier, the fibers are directed through the openings of the perforated drum and form a web of homogeneous fiber distribution on the surface of the carrier. The height and degree of matting of the dry web may be varied via control of process variables including fiber content and size, drum aperture size and shape, rate of air flow, degree of suction applied from the bottom of the carrier and carrier speed. Other equipment controls may also be varied to provide unique matting construction.

The width of the web depends upon the type of air former equipment employed and may vary from 1 m to 6 m. Conventional commercial units such as supplied by Dan-Web, Oerlikon and Anpap Oy range from 2 to 5 m in width.

According to the present invention the formed air laid web is directly and continuously transported to a hydroentanglement unit or spunlacing unit, where the airlaid mat is struck with a series of high pressure water jets to mechanically entangle or consolidate the fibers and form the nonwoven web. The jets may be oriented perpendicular to the surface of the carrier or angled to provide unique properties to the web. Jets may be placed to consolidate the web from one side, preferably, the top side or from both the top and bottom side. The pressure of the jets may be from 0.04 bars/kg/h/m to 15 bars/kg/h/m, preferably, 0.1 bars/kg/h/m to 10 bars/kg/h/m, and most preferably 0.3 bars/kg/h/m to 4 bars/kg/h/m.

An embodiment showing an arrangement of units to produce the nonwoven web with an air laid precursor is shown schematically in FIG. 1. An airforming system is shown as unit (7), wherein the blend of at least one of defibrated natural plant based fibers, individualized natural plant based fibers and staple fibers (1), (2) is homogeneously mixed in supply unit (3) and then transferred into rotating cylinder (4) having perforations (5). The blend of at least one of defibrated natural plant based fibers, individualized natural plant based fibers and staple fibers pass through the perforations onto the foraminous carrier (6) which transports the airlaid web through the hydroentangling unit (8). In the hydroentangling unit (8) the air laid web is passed along a series of carrier belts and exposed to high pressure jets indicated in numerical order. Jets 11, 12 and 13 impinge the top of the web while jets 21 and 22 strike the opposite or bottom side. The schematic jets 11-13, 21-22, 31-33, 41-43 and 51-52 represent banks of jets across the width of the web and the jet banks may be positioned and arranged to impart varying completeness of entanglement across the web. Thus, the entanglement may be patterned or random depending on the intended end use of the nonwoven web. From the unit (8) the consolidated web is dried in drying unit (9).

The drape, softness and comfortable hand of the nonwoven web may be controlled by the energy delivered by the high pressure jets and by the speed of travel of the web through the equipment. According to the present invention by control of both water pressure and speed of web travel through the spunlacing equipment as well as the absence of adhesives, binders or bonding fibers, a nonwoven web having varying degrees of strength, absorbency, softness and thickness may be obtained.

Spunlacing or hydroentanglement units are available from Fleissner GmbH (Germany) and Andritz Perfojet (France).

In one variation of the above basic embodiment, multiple airlaid webs may be prepared and stacked prior to spunlacing so that thicker nonwoven webs may be produced. The respective stacked layers may be of the same fiber composition or may have differing compositions selected for the intended end use of the nonwoven web as previously described. In each such possible embodiment, entanglement may be achieved by variation of water jet pressure and speed of travel of the web through the spunlacing unit. According to the present invention no binders, adhesives or bonding fibers are utilized.

Following the spunlacing the wet nonwoven web may be dried and wound for transport and storage.

Figure 2:
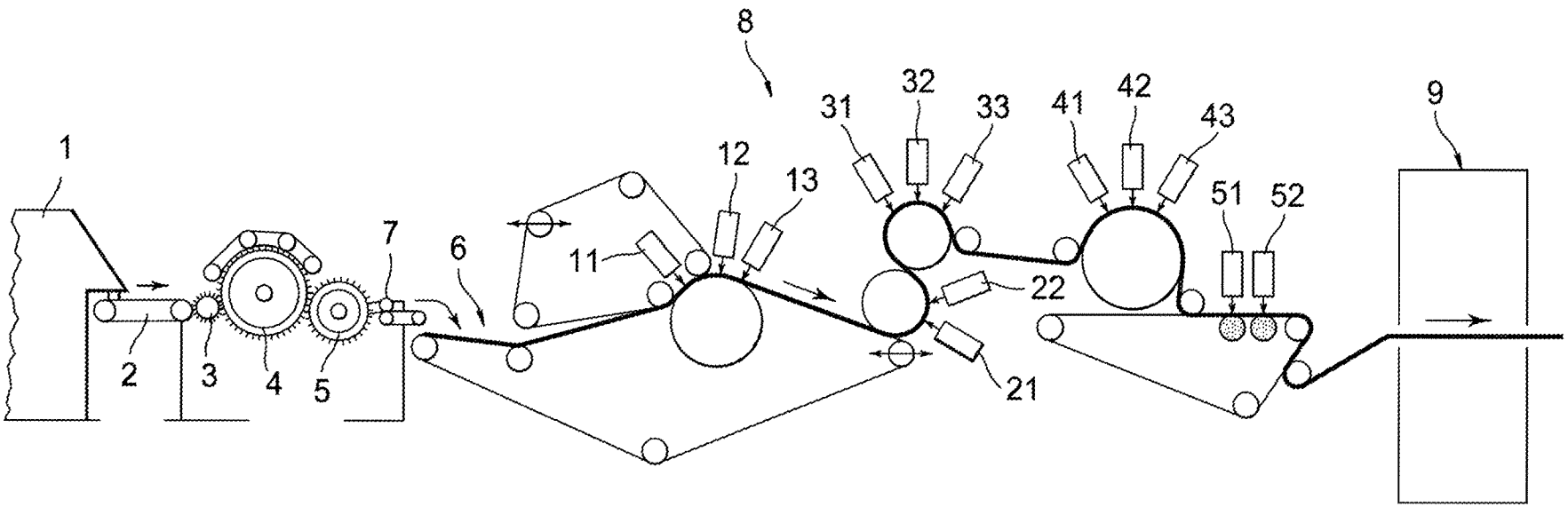
FIG. 2 shows a schematic drawing of a continuous system according to the third embodiment of the invention.

In a third embodiment, the present invention provides another method to prepare the nonwoven homogeneous web according to the first embodiment. The method of the third embodiment includes preparing a homogeneous dry mixture consisting of at least one of defibrated natural plant based fibers, individualized natural plant based fibers and staple fibers; carding and dry laying the mixture to obtain at least one homogeneous dry laid web; hydroentangling the dry laid web to consolidate the web on at least one side; and drying the hydroentangled web to obtain the nonwoven web. Generally, the fibers are provided as bales which are opened and then the coarsely opened fibers (or fiber clumps) are conveyed to the fiber opener and further conveyed (usually by air) to the carding machine where they are carded, then removed from the main cylinder by doffing. After the doffer, the fibers may be passed through or under a roller to obtain a small degree of consolidation and uniformity in level and height after which it passes to the belt (foraminous carrier) for transfer to the hydroentanglement section. This is shown schematically in FIG. 2 wherein the blend of at least one of defibrated natural plant based fibers, individualized natural plant based fibers and staple fibers is fed from a supply unit (1) via conveyor belt (2) to lickerin (3) and onto card cylinder (4) where the fibers are carded and then collected on doffer (5) and passed through rolls (7) and dry laid onto the foraminous carrier (6) which transports the airlaid web through the hydroentangling unit (8) and then to drying unit (9) as described above for FIG. 1.

The carding, dry laying and hydroentangling may be conducted in a continuous operation.

Carding provides a mechanical process that disentangles and intermixes the fibers to produce a homogeneous continuous dry web deposited on the foraminous carrier. This is achieved by passing the fibers between differentially moving surfaces covered with card clothing. It breaks up locks and unorganized clumps of fiber and then aligns the individual fibers to be parallel with each other. Mechanical carding of fibers is a known method of preparing dry laid webs and may be conducted in carding equipment such as the Trutzschler-Fliessner EWK-413 card which is commercially available from Trutzschler, Moenchengladbach Germany. Other commercially available carding units may be similarly employed as recognized by one of skill in the art.

Once the dry laid carded homogeneous web is formed it may be processed by the spunlacing or hydroentangling methods and equipment previously described.

In a further embodiment, prior to drying, the hydroentangled web may be embossed either by a hydroembossing process or by thermal embossing.

The basis weight of the nonwoven web obtained by the methods of the second and third embodiments may be from 20 g/m$^2$ to 100 g/m$^2$, preferably 40 g/m$^2$ to 80 g/m$^2$ for a nonwoven web of from 0.25 mm to 2 mm in thickness. However, when multiple airlaid webs are stacked, the basis weight and thickness may not be in these ranges. Basis weight may be varied by control of the process variables described for both the airlaying or carding and spunlacing operations and by other process variables conventionally known to one of skill in the present technology.

The nonwoven webs according to the present invention may be designed and constructed for a large variety of utilities. Because the web is free of adhesives, binders and binding fibers the webs are readily disposable and in selected compositions as described, dispersible and even flushable in standard toilet systems. Possible end uses may include wipes include baby wipes, cosmetic wipes, perinea wipes, disposable washcloths, household cleaning wipes, such as kitchen wipes, bath wipes, or hard surface wipes, disinfecting and germ removal wipes, specialty cleaning wipes, such as glass wipes, mirror wipes, leather wipes, electronics wipes, lens wipes, and polishing wipes, medical cleaning wipes, disinfecting wipes, and the like. Additional examples of products include sorbents, medical supplies, such as surgical drapes, gowns, and wound care products, personal protective products for industrial applications, such as protective coveralls, sleeve protectors, and the like, protective coverings for automotive applications, and protective coverings for marine applications. The nonwoven fabric can be incorporated into absorbent cores, liners, outer-covers, or other components of personal care articles, such as diapers (baby or adult), training pants, feminine care articles (pads and tampons) and nursing pads.

The above description is presented to enable a person skilled in the art to make and use the embodiments and aspects of the disclosure, and is provided in the context of a particular application and its requirements. Various modifications to the preferred embodiments will be readily apparent to those skilled in the art, and the generic principles defined herein may be applied to other embodiments and applications without departing from the spirit and scope of the disclosure. Thus, this disclosure is not intended to be limited to the embodiments shown, but is to be accorded the widest scope consistent with the principles and features disclosed herein. In this regard, certain embodiments within the disclosure may not show every benefit of the disclosure, considered broadly.

The invention claimed is:

1. A nonwoven web, comprising:

at least one first homogeneous layer consisting of a blend of a staple fiber and at least two fibers selected from defibrated natural plant based fibers and individualized natural plant based fibers;

wherein the at least one homogeneous layer comprises no binder, adhesive or thermal bonding fiber, a basis weight of the at least one homogeneous layer is from 20 g/m$^2$ to 100 g/m$^2$, a fineness of the staple fiber is from 2.0 denier to 10.0 denier, wherein the individualized natural plant based fibers are fibers selected from the group consisting of a flax fiber, a hemp fiber, a jute fiber, a ramie fiber, a nettle fiber, a Spanish broom fiber and a kenaf plant fiber which have been individualized to single fibers by mechanical, chemical or enzymatic treatment of the bast fibers, when a weighted average fiber length of the blend of fibers is greater than about 4.0 mm, the nonwoven web is a non-dispersible product which does not meet the requirement for dispersibility in accordance with INDA/EDANA GD4, and when a weighted average fiber length of the blend of fibers is less than about 4.0 mm, the nonwoven web is a dispersible product as defined in accordance with INDA/EDANA GD4.

2. The nonwoven web according to claim 1, wherein the blend comprises at least one defibrated natural plant based fiber; wherein the at least one defibrated natural plant based fiber is selected from the group consisting of a wood pulp, a cotton pulp, a pulp of a natural plant different from wood and cotton, cotton, cotton linters, cotton combers, bamboo, bast, ramie, hemp, kapok, flax, jute, sisal and abaca.

3. The nonwoven web according to claim 2, wherein a length-weighted average fiber length of the defibrated natural plant based fiber is from 0.5 mm to 8.0 mm.

4. The nonwoven web according to claim 1, wherein the staple fiber is at least one selected from the group consisting of a regenerated cellulose fiber, cotton, polyethylene terephthalate (PET), polypropylene, polylactic acid, esters of polylactic acid, amides of polylactic acid, milk protein and nylon.

5. The nonwoven web according to claim 4, wherein a fiber length of the staple fiber is from 3 mm to 100 mm.

6. The nonwoven web according to claim 4, wherein a cross-sectional geometry of the staple fiber is one selected from the group of geometries consisting of flat, circular, trilobal and X-shaped.

7. The nonwoven web according to claim 1, wherein an individualized natural plant based fiber is present and a length-weighted average fiber length of the individualized natural plant based fiber is from 3 mm to 100 mm.

8. The nonwoven web of claim 1, wherein a basis weight of the nonwoven web is from 25 g/m$^2$ to 100 g/m$^2$.

9. The nonwoven web according to claim 1, wherein the nonwoven web has a wet MD/CD ratio less than 4.

10. The nonwoven web according to claim 1, wherein a weighted average fiber length of the staple fiber and at least two fibers selected from defibrated natural plant based fibers and individualized natural plant based fibers is less than about 4.0 mm, and a CD wet tensile strength is at least 2.5 N/5 cm.

11. The nonwoven web according to claim 1, wherein a weighted average fiber length of the staple fiber and at least two fibers selected from defibrated natural plant based fibers and individualized natural plant based fibers is greater than about 4.0 mm, and a CD wet tensile strength is at least 5 N/5 cm.

12. The nonwoven web according to claim 1, comprising:

from 10 to 90 weight % of defibrated natural plant based fibers and/or individualized natural plant based fibers; and from 10 to 90 weight % of staple fibers.

13. The nonwoven web according to claim 1 which comprises at least two first homogeneous layers.

14. The nonwoven web according to claim 1 further comprising at least one second homogeneous layer consisting of a blend of at least one of defibrated natural plant based fibers or individualized natural plant based fibers and staple fibers; wherein the at least one second homogeneous layer comprises no binder, adhesive or thermal bonding fiber, a basis weight of the at least one second homogeneous layer is from 20 g/m$^2$ to 100 g/m$^2$, and the at least one first homogeneous layer and the at least one second homogeneous layer have differing compositions.

15. A method to prepare the nonwoven web according to claim 1, comprising:

preparing a homogeneous dry mixture of a staple fiber and at least two fibers selected from defibrated natural plant based fibers and individualized natural plant based fibers dry laying the mixture to obtain at least one homogeneous dry laid web;

hydroentangling the dry laid web to consolidate the web on at least one side; and drying the hydroentangled web to obtain the nonwoven web;

wherein the dry laying and hydroentangling is conducted in a continuous operation, no binder, adhesive or thermal bonding fibers are utilized, and a thickness of the nonwoven web is from 0.25 mm to 2 mm.

16. The method according to claim 15, wherein the homogeneous dry mixture comprises from 10 to 90 weight % of defibrated natural plant based fibers and/or individualized natural plant based fibers; and from 10 to 90 weight % of staple fibers.

17. The method according to claim 15, wherein the dry laying comprises passing the homogeneous dry mixture through a perforated cylinder and air laying onto the foraminous carrier.

18. The method according to claim 15, wherein the homogeneous dry laid web is hydroentangled on an upper side of the web away from the foraminous carrier.

19. The method according to claim 15, wherein the homogeneous dry laid web is hydroentangled on an upper side of the web away from the foraminous carrier and on a side on the foraminous carrier.

20. The method according to claim 15, wherein the homogeneous airlaid web is hydroentangled on an upper side of the web away from the foraminous carrier.

21. The method according to claim 15, wherein the homogeneous airlaid web is hydroentangled on an upper side of the web away from the foraminous carrier and on a side on the foraminous carrier.

22. A method to prepare the nonwoven web according to claim 1, comprising:

preparing a homogeneous dry mixture consisting of a staple fiber and at least two fibers selected from defibrated natural plant based fibers and individualized natural plant based fibers;

carding and dry laying the mixture to obtain at least one homogeneous dry laid web;

hydroentangling the dry laid web to consolidate the web on at least one side; and drying the hydroentangled web to obtain the nonwoven web;

wherein the carding, dry laying and hydroentangling is conducted in a continuous operation, no binder, adhesive or thermal bonding fibers are utilized, and a thickness of the nonwoven web is from 0.25 mm to 2 mm.

23. The method according to claim 22, wherein the dry laying comprises passing the carded homogeneous dry mixture onto a foraminous carrier.

24. The method according to claim 22 wherein the carded homogeneous dry laid web is hydroentangled on an upper side of the web away from the foraminous carrier.

25. The method according to claim 22 wherein the carded homogeneous dry laid web is hydroentangled on an upper side of the web away from the foraminous carrier and on a side on the foraminous carrier.

* * * * *